United States Patent [19]

Humphreys et al.

[11] 4,094,807

[45] June 13, 1978

[54] PREPARATION OF DETERGENT BARS CONTAINING ZINC OXIDE

[75] Inventors: Peter Franklin Humphreys, Great Sutton; Edwin Willis, Bromborough, both of England

[73] Assignee: Lever Brothers Company, New York, N.Y.

[21] Appl. No.: 803,715

[22] Filed: Jun. 6, 1977

Related U.S. Application Data

[63] Continuation of Ser. No. 648,224, Jan. 12, 1976, abandoned, which is a continuation of Ser. No. 554,879, Mar. 3, 1975, abandoned.

[30] Foreign Application Priority Data

Mar. 7, 1974 United Kingdom ..... 10304/74
Aug. 23, 1974 United Kingdom ..... 37136/74

[51] Int. Cl.[2] ..... C11D 3/12; C11D 9/20; C11D 17/00

[52] U.S. Cl. ..... 252/131; 252/90; 252/132; 252/134; 252/174; 252/DIG. 16

[58] Field of Search ..... 252/131, 132, 134, 174, 252/90, 92, 367, 368, 370, 522, DIG. 16; 260/398.5

[56] References Cited

U.S. PATENT DOCUMENTS

| | | | |
|---|---|---|---|
| 787,776 | 4/1905 | Liebnecht | 252/131 |
| 2,649,417 | 8/1953 | Compa | 252/367 |
| 3,850,834 | 11/1974 | Hellsten | 252/DIG. 16 |

FOREIGN PATENT DOCUMENTS

| | | | |
|---|---|---|---|
| 198,681 | 8/1924 | United Kingdom | 252/133 |

OTHER PUBLICATIONS

Bennett — "The Chemical Formulary," vol. I, 1910, van Nostrand Co., p. 86.
Hackhis — "The Chemical Dictionary," 4th Ed., McGraw-Hill Co., 1969, p. 735.

*Primary Examiner*—Harris A. Pitlick
*Attorney, Agent, or Firm*—Melvin H. Kurtz

[57] ABSTRACT

The invention relates to a method of incorporating zinc oxide into a detergent bar. In order to avoid grittiness in the bar the zinc oxide is slurried in an aqueous or organic liquid before it is added to the detergent material. Preferably the zinc oxide used has a particle size distribution such that not more than about 5% by weight of the oxide is held on a 10 micron sieve and not more than about 3% by weight is held on a 30 micron sieve. The invention is particularly applicable to the production of superfatted bars.

15 Claims, No Drawings

PREPARATION OF DETERGENT BARS CONTAINING ZINC OXIDE

This a continuation of application Ser. No. 648,224, filed Jan. 12, 1976, now abandoned, which is a continuation of Ser. No. 554,879, filed Mar. 3, 1975, now abandoned.

This invention relates to methods of preparing detergent bars for personal washing. Specifically it relates to methods of incorporating zinc oxide into these bars.

Zinc oxide is known as a component of such bars as an opacifier. The present invention proposes a method of incorporating zinc oxide into a detergent bar in the form of a slurry at the mixing stage. The invention is particularly applicable to detergent bars containing free fatty acids. When incorporating zinc oxide into detergent bars containing free long chain fatty acids ($C_8$–$C_{22}$) it has been found that the bars show a gritty feel during use unless specific process steps of the present invention are used in the bar preparation. The problem is found when the bar contains at least about 1% by weight of the free fatty acid, the usual maximum amount of which in a bar is up to about 15% by weight for soap bars but can be higher, i.e. up to 25%. A non-soap detergent bar containing about 20% free stearic acid is commercially produced. The detergent active can be any of those proposed for use in detergent bars for example $C_8$ to $C_{22}$ fatty acid alkali metal salts, $C_8$ to $C_{22}$ alkane sulphonates, olefin sulphonates, alkylaryl sulphonates, isethionates and mixtures thereof, (other actives are disclosed in "Surface Active Agents" by Schwartz & Perry published by Interscience in 1949 and Volume II by Schwartz, Perry & Birch published by Interscience in 1958.

The invention is a method of preparing detergent bars containing zinc oxide wherein i. zinc oxide having a particle size distribution with not more than about 5% by weight held on a 10 micron sieve and not more than about 3% by weight is held on a 30 micron sieve is formed into a slurry with a liquid medium,
ii. the slurry is added to and mixed with a detergent material at the mixing stage, and
iii. the detergent material is milled, plodded and stamped to form bars.

The amount of zinc oxide in the bars will usually be in the range from about 0.1 to about 2% by weight. Preferably the detergent material is milled as soon as possible after the slurry has been added at the mixing stage, preferably the milling step is performed within 15 minutes of the mixing step. The short period before milling ensures grittiness is not present in the stamped bar nor develops during use. The mixing should also be performed as rapidly as possible; in general it is found that relatively large batches of free fatty acid detergents require a time for mixing which normally leads to bar grittiness.

The particle size analysis was performed by dispersing zinc oxide (1g) in a 2% w/w soap solution (50 ml). The filters used were BMC micromesh.

The usual range of free fatty acid is from 5% to 10% and the preferred amount of zinc oxide is from 0.3 to 1.2%. Although slurry viscosities above 200 poises are usable this will be the limit when standard manufacturing and handling techniques are used. Preferably the viscosity will be below 25 poises. The slurry will preferably contain from about 10 to about 80% by weight of zinc oxide and more preferably about 20 to about 70%.

The liquid medium may be based on water or an organic liquid. Mixtures of these liquids may also be used, thus a short chain alcohol may be used in admixture with water. The organic liquids listed later may also be used in admixture with each other or with water. An aqueous medium may require a surfactant to stabilise the slurry, preferably about 0.1 to about 5 % by weight. Organic liquid slurries may also require a stabilising agent. Organic liquids which can be used are perfumes, which are aromatic liquids normally used in small amounts in the preparation of detergent bars, long chain alcohols, for example $C_{13}$ to $C_{15}$, liquid polyethylene glycols of low molecular weight so that the slurry has the desired viscosity, dimethyl lauramide, methyl tallowate, nonly phenol ethoxylated to an average of nine units, ethoxylated alcohols, for example $C_{12}$–$C_{14}$ branched alcohols ethoxylated with from 12 to 14 units, ethyl hexane diol, glycerol trioleate, glycerol, phenoxy ethanol, capric diethanolamide and ethoxylated amides, for example cocodiethanolamide ethoxylated with an average of 25 units. Some of these organic liquids have desirable benefits in the bar. The organic liquids may be miscible or immiscible with water and in the latter it may be necessary to ensure the amounts used does not interfere with the lather or other user properties.

The temperature of the detergent mass to which the slurry is added is preferably below 40° C because above this temperature grittiness may develop in the bar during use — now onto the Examples.

Examples of the method according to the invention will now be given.

The zinc oxide used in the following Examples was obtained from the Durham Raw Materials Co. of Altrincham and London, England, and had a nominal (average) particle size of 0.25 micron.

EXAMPLE I 50g of zinc oxide (pharmaceutical grade) was dispersed in 100 ml of 1% tallow soap solution using a Silverson mixer. The zinc oxide powder satisfied the particle size distribution quoted above. The soap contained free fatty acid and had the composition of 75 parts sodium tallow acid
25 parts sodium coconut fatty acid
6 parts free coconut fatty acid The soap (1,946g) was placed in a mixer and 59g of the zinc oxide slurry was added; the free fatty acid must be completely and evenly mixed in the soap before the slurry is added. At this mixing stage other components will also be be added, for example, pigments, e.g. titanium dioxide, perfumes, dyes and fluorescers.

The soap was mixed until the components were throughly mixed and was then milled, plodded and stamped to forms bars for personal washing. The bars had a smooth feel while in use.

EXAMPLE II

A superfatted soap bar as prepared having the formulation:

| | % by weight |
|---|---|
| Sodium tallow soap | 65 |
| Sodium coconut soap | 15 |
| Coconut fatty acid | 7 |
| Perfume | 0.75 |
| Zinc oxide (as slurry) | 1.25 |

-continued

| | % by weight |
|---|---|
| Water/sodium chloride and minor components | 11.00 |

The slurry was prepared by adding 1.8 kg of zinc oxide (pharmaceutical grade) to 0.77 kg of a 4% w/w sodium dodecyl benzene sulphonate solution in water and mixing the whole in a Silverson mixer for 10 minutes. 0.65 kg of the slurry was then added to 50 kg of the superfatted soap together with perfume and colouring agent and mixed and milled at a rate of 1 ton per hour. The milled soap was plodded, cut into billets and stamped. The tablets were smooth when made and remained so during use.

EXAMPLE III

Example I was repeated using for the slurry a solution of 0.5% w/w of Nonidet P80, an ethoxylated octyl phenol obtainable from Shell Limited.

EXAMPLE IV 0.9 parts of powdered zinc oxide were mixed with 0.7 parts of a fresh herbal fougere perfume by manual stirring in a stainless steel vessel. This mixture was then passed through a colloid mill set to a gap of 0.0025 inches to produce a thick stable cream.

1.6 parts of the zinc oxide cream were added to 98.34 parts of superfatted soap noodles in a ribbon-type mixer together with 0.56 parts of a colour slurry and then mixed for 4 minutes. The resultant mixture was passed through a 3-roll soap mill and then refined and vacuum plodded. The plodded bars were cut and stamped into tablets in the conventional manner. When used in both cold and warm water the tablets were judged to have good properties with satisfactorily smooth feel for personal washing.

EXAMPLE V

Example IV was repeated using as the perfume the following formulation (parts by weight)

| | |
|---|---|
| Acetanisole | 40 |
| Bergamot synthetic | 150 |
| Coumarin | 200 |
| Geranium synthetic | 150 |
| Lavandin abrialis | 100 |
| Mousse de chene absolute | 50 |
| Musk ketone | 30 |
| Patchouli A.W | 30 |
| Sandela | 110 |
| Tolu abs. 50% | 70 |
| Vetyvert bourbon | 20 |

-continued

| | |
|---|---|
| Ylang synthetic | 50 |

The tablets obtained had acceptable properties for personal washing with a satisfactory smooth feel.

We claim:

1. A method of preparing detergent bars containing from about 0.1% to about 2% by weight of zinc oxide wherein i. zinc oxide is formed into a slurry containing from about 10 % to about 80% by weight of said oxide with a liquid medium, ii. the slurry is added to and mixed with a detergent material at the mixing stage, and iii. the detergent material is milled, plodded and stamped to form bars.

2. A method of according to claim 1, wherein the zinc oxide has a particle size distribution such that not more than about 5% by weight of the oxide is held on a 10 micron sieve and not more than about 3% by weight is held on a 30 micron sieve.

3. A method according to claim 1 wherein the liquid medium is aqueous.

4. A method according to claim 3, wherein the medium contains an amount of surfactant effective to stabilise the slurry.

5. A method according to claim 4, wherein the surfactant is present in an amount of from about 0.1% to about 5% by weight of the slurry.

6. A method according to claim 1, wherein the liquid medium is organic.

7. A method according to claim 6, wherein the organic liquid is a perfume.

8. A method according to claim 1 wherein the detergent material contains at least about 1% be weight of free fatty acid containing from 8 to 22 carbon atoms.

9. A method according to claim 8, wherein the detergent material contains up to about 25% by weight of free fatty acid.

10. A method according to claim 9, wherein the detergent material contains up to about 15% by weight of free fatty acid.

11. A method according to claim 1 wherein the milling step is performed within 15 minutes of completing the mixing step.

12. A method according to claim 1 wherein the slurry has a viscosity not above about 200 poises.

13. A method according to claim 12, wherein the slurry has a viscosity not above 25 poises.

14. A method according to claim 1, wherein the slurry contains from about 20% to about 70% of zinc oxide.

15. The method according to claim 1, wherein the detergent material has a temperature below 40° C at the mixing stage.

* * * * *